US008893682B2

(12) United States Patent
Terada et al.

(10) Patent No.: US 8,893,682 B2
(45) Date of Patent: Nov. 25, 2014

(54) MULTI-CYLINDER INTERNAL COMBUSTION ENGINE

(75) Inventors: Koji Terada, Saitama (JP); Kenichiro Nakamura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 314 days.

(21) Appl. No.: 12/883,769

(22) Filed: Sep. 16, 2010

(65) Prior Publication Data

US 2011/0061627 A1 Mar. 17, 2011

(30) Foreign Application Priority Data

Sep. 16, 2009 (JP) ..... 2009-215039

(51) Int. Cl.

| | |
|---|---|
| ***F01M 11/02*** | (2006.01) |
| ***F02F 7/00*** | (2006.01) |
| ***F02B 61/04*** | (2006.01) |
| *F01M 11/00* | (2006.01) |

(52) U.S. Cl.

CPC ..... *F01M 11/02* (2013.01); *F01M 2011/0066* (2013.01); *F01M 2011/023* (2013.01); *F01M 11/0004* (2013.01); *F01M 2011/005* (2013.01)

USPC ..... 123/196 R; 123/195 R; 123/195 H; 123/196 W

(58) Field of Classification Search

USPC ..... 123/196 R, 195 R, 195 H, 196 W

See application file for complete search history.

(56) References Cited

U.S. PATENT DOCUMENTS

| | | | | |
|---|---|---|---|---|
| 6,332,444 | B1 * | 12/2001 | Narita et al. | 123/196 R |
| 7,100,562 | B2 * | 9/2006 | Terada et al. | 123/195 R |
| 7,165,651 | B2 * | 1/2007 | Hiraga | 184/6.12 |
| 7,240,657 | B2 * | 7/2007 | Watanabe | 123/196 R |

FOREIGN PATENT DOCUMENTS

JP 2004-143952 A 5/2004

* cited by examiner

*Primary Examiner* — Lindsay Low
*Assistant Examiner* — Syed O Hasan
(74) *Attorney, Agent, or Firm* — Birch, Stewart, Kolasch & Birch, LLP

(57) ABSTRACT

A multi-cylinder internal combustion engine includes a one-side crank chamber and an other-side crank chamber formed by partitioning a lower crankcase by a plurality of lower support walls which are provided integrally with the lower crankcase and support a crankshaft. A plurality of oil outflow holes respectively communicate with the one-side crank chamber and the other-side crank chamber through which oil is discharged from the one-side crank chamber and the other-side crank chamber. An oil discharge port is provided along a lower support wall of the one-side crank chamber and the other-side crank chamber. A suction port of a scavenging pump for discharging the oil present in the one-side crank chamber and the other-side crank chamber is provided in an outer wall in the manner of straddling the lower support wall.

20 Claims, 9 Drawing Sheets

MULTI-CYLINDER INTERNAL COMBUSTION ENGINE

CROSS-REFERENCE TO RELATED APPLICATIONS

The present application claims priority under 35 USC 119 to Japanese Patent Application No. 2009-215039 filed on Sep. 16, 2009 the entire contents of which are hereby incorporated by reference.

BACKGROUND OF THE INVENTION

1. Field of the Invention

The present invention relates to a multi-cylinder internal combustion engine in which oil is discharged from a plurality of crank chambers.

2. Description of Background Art

A multi-cylinder internal combustion engine is known wherein an oil pan for collecting oil is provided on the lower side of a plurality of crank chambers and the oil is fed from the oil pan to oil pump through a pipe. See, for example, Japanese Patent Laid-Open No. 2004-143952.

In the conventional multi-cylinder internal combustion engine mentioned above, the oil is fed to the oil pump by use of the oil pan and the pipe. This configuration therefore has had a problem of an increase in the number of component parts and a complicated structure.

SUMMARY AND OBJECTS OF THE INVENTION

The present invention has been made in consideration of the above-mentioned circumstances. Accordingly, it is an object of an embodiment of the present invention to reduce the number of component parts of a multi-cylinder internal combustion engine to enable the engine to be simplified in structure.

In order to attain the above object, according to an embodiment of the present invention, there is provided a multi-cylinder internal combustion engine including a plurality of independent crank chambers formed by partitioning a crankcase by a plurality of support walls which are provided integrally with the crankcase for supporting a crankshaft, and a plurality of oil outflow holes which respectively communicate with the crank chambers and through which oil is discharged from each of the crank chambers, wherein an inner wall of the adjacent crank chambers is provided with an oil discharge port along the support wall. A suction port of a scavenging pump, for discharging the oil present in the crank chambers, is provided in a crank chamber outer wall in the manner of straddling the support wall.

According to this configuration, the oil discharge port is provided along the support wall of the adjacent crank chambers, and the suction port of the scavenging pump is provided directly in the crank chamber outer wall in the manner of straddling the support wall. Therefore, the oil in each of the adjacent crank chambers is supplied directly from the oil discharge port to the scavenging pump. Accordingly, there is no need for a component part for collecting portions of oil flowing out of a plurality of oil discharge ports and causing the collected oil to flow to the scavenging pump. Consequently, it is possible to reduce the number of component parts and to realize a simplified structure.

In addition, a mounting surface for a journal bolt for fixing the crankshaft to the crankcase may be formed in the suction port of the scavenging pump.

In this case, since the mounting surface for the journal bolt is formed in the suction port, the scavenging pump can be disposed at a desired position such as to straddle the support wall, even in such a layout that the journal bolt would constitute an obstacle in providing the scavenging pump at the crank chamber outer wall in the manner of straddling the support wall.

In addition, a lower inner wall of the crankcase may be provided with a recessed part including the oil discharge port, and with oil slinger rib proximate to a peripheral surface of a crank web along the recessed part.

In this case, the oil adhering to the crank web can be removed by the oil slinger rib, so that resistance to the rotation of the crankshaft can be reduced.

Further, a feed pump by which oil in oil pan is fed through oil filter to each part to be supplied with the oil may be provided coaxially with the scavenging pump, and oil passage extending from a discharge port of the feed pump to the oil filter may be formed in a crankcase wall.

In this case, since the oil passage extending from the discharge port of the feed pump to the oil filter is formed in the crankcase wall, there is no need for a component part for connection between the feed pump and the oil filter, and the number of component parts can be reduced.

In addition, an oil pump mounting surface may be formed as a slant surface slanted against a front-rear direction at a lower portion of the crankcase, the oil slinger rib may be provided on the upper side of the slant surface, and the discharge port of the feed pump may be provided on the lower side of the slant surface.

In this case, in the case of providing the oil slinger rib in proximity to the crank web, the length of the oil slinger rib can be shortened. In addition, an oil passage for connection of the discharge port of the feed pump can be formed in the crankcase by utilizing a space formed by the slant surface. For example, an oil passage for connection between the feed pump and the oil filter can be formed.

In the multi-cylinder internal combustion engine according to an embodiment of the present invention, the suction port of the scavenging pump is provided directly in the crank chamber outer wall in the manner of straddling the support wall of the adjacent crank chambers. Therefore, the oil in each of the adjacent crank chambers is supplied directly from the oil discharge port to the scavenging pump. Accordingly, there is no need for a component part for collecting the portions of the oil flowing out from a plurality of oil outflow holes and causing the collected oil to flow to the scavenging pump. Consequently, the number of component parts is reduced, and a simplified structure can be realized.

Also, the scavenging pump can be disposed at a desired position such as to straddle the support wall, even in such a layout that the journal bolt would constitute an obstacle in providing the scavenging pump at the crank chamber outer wall in the manner of straddling the support wall.

In addition, since the oil adhering to the crank web can be removed by the oil slinger rib, resistance to the rotation of the crankshaft can be reduced.

Further, since the oil passage extending from the discharge port of the feed pump to the oil filter is formed in the crankcase wall, there is no need for a component part for connection between the feed pump and the oil filter, so that the number of component parts can be reduced.

In addition, in the case of providing the oil slinger rib in proximity to the crank web, the length of the oil slinger rib can be shortened. In addition, the oil passage for connection of the discharge port of the feed pump can be formed in the crankcase by utilizing the space formed by the slant surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
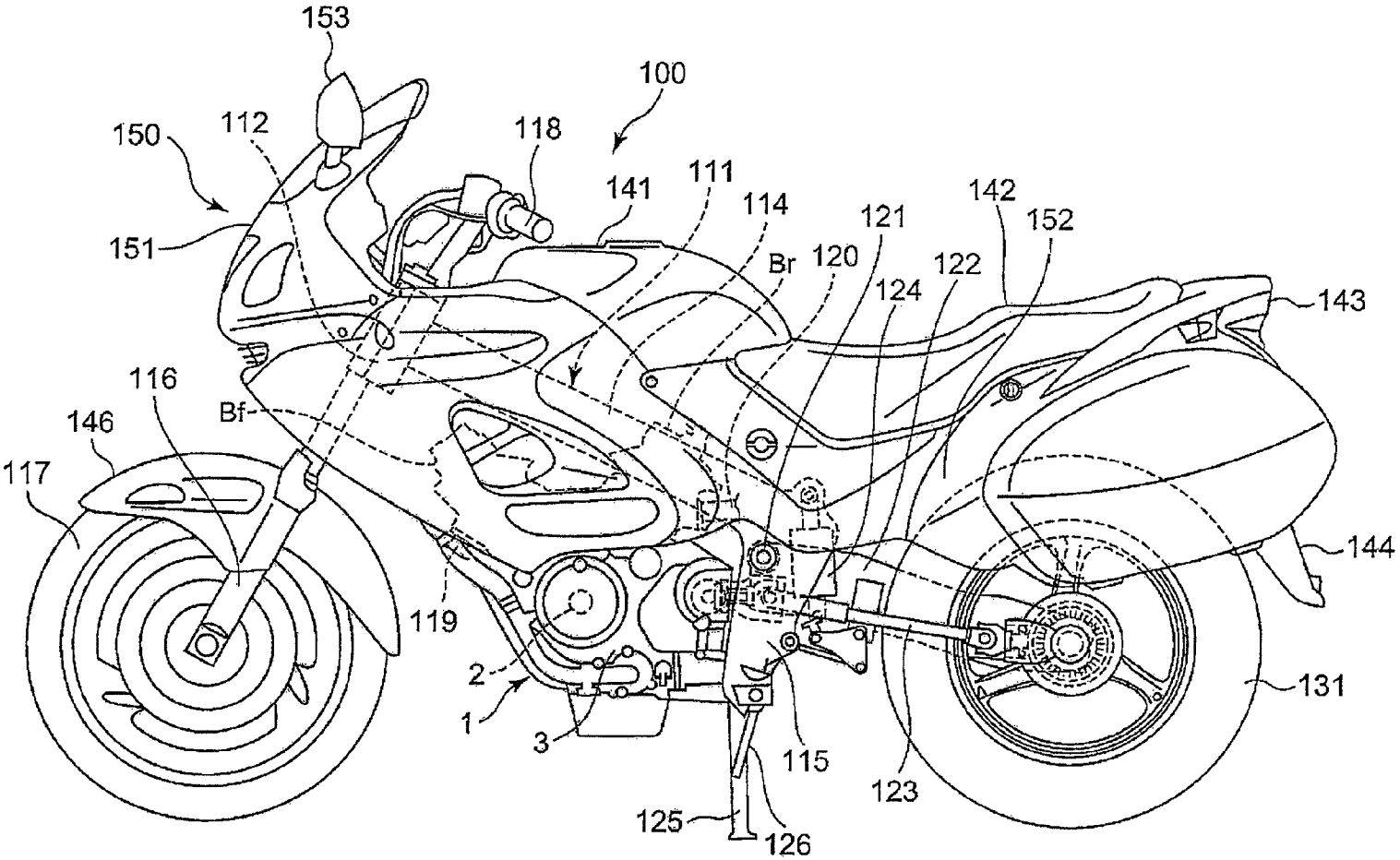
FIG. 1 is a side view of a motorcycle equipped with a multi-cylinder internal combustion engine according to an embodiment of the present invention.

An embodiment of the present invention will be described below referring to the drawings.

FIG. 1 is a side view of a motorcycle equipped with a multi-cylinder internal combustion engine according to an embodiment of the present invention. In the following description, the directions such as front, rear, left, right, up and down refer to those directions with reference to a vehicle body.

A body frame 111 of a motorcycle 100 includes a head pipe 112 located at a front portion of the vehicle body, a pair of left and right main frames 114 extending rearward from the head pipe 112 to the center of the vehicle body, a pair of left and right pivot plates 115 extending downward from rear end portions of the main frames 114, and a rear frame (not shown) extending from the rear end portions of the main frames 114 to a rear portion of the vehicle body.

A front fork 116 is turnably mounted to the head pipe 112, and a front wheel 117 is rotatably mounted to the lower ends of the front fork 116. In addition, a steering handle 118 is mounted to an upper portion of the head pipe 112.

A front-rear V-type 4-cylinder internal combustion engine 1 (multi-cylinder internal combustion engine) is disposed on the lower side of the main frames 114. The internal combustion engine 1 is a transverse engine having a crankshaft 2 oriented in a left-right horizontal direction, is of an OHC type, and is of a water-cooled type. The internal combustion engine 1 is a narrow-angle V-type engine which has a crankcase 3 and in which a front bank Bf having two cylinders slanted toward the front side and a rear bank Br having two cylinders slanted toward the rear side are extended from the crankcase 3 to be V-shaped as a whole, with a bank angle of less than 90 degrees.

One-side ends of a pair of left and right exhaust pipes 119 are connected to exhaust ports in the front bank Bf. These exhaust pipes 119 extend downward from the exhaust ports, are then laid around toward the rear side of the vehicle body, are collectively connected to a pair of left and right exhaust pipes 120 extending from exhaust ports in the rear bank Br, and the resulting exhaust pipe is connected through a single exhaust pipe (not shown) to a muffler (not shown) provided on the rear side of the internal combustion engine 1.

A pivot shaft 121 is provided on the rear side of the internal combustion engine 1, and a rear fork 122 is mounted to the pivot shaft 121 in such a manner that it can be swung up and down about the pivot shaft 121. A rear wheel 131 is rotatably supported on rear end portions of the rear fork 122. The rear wheel 131 and the internal combustion engine 1 are interconnected by a drive shaft 123 provided inside the rear fork 122, and a rotational drive force is transmitted from the internal combustion engine 1 to the rear wheel 131 through the drive shaft 123. In addition, a rear shock absorber 124 for absorbing a shock transmitted from the rear fork 122 is bridgingly provided between the rear fork 122 and the body frame 111.

A stand 125 for resting of the vehicle body is provided at a rear portion of the internal combustion engine 1. In addition, a side stand 126 is provided at a lower portion of a left side surface of the internal combustion engine 1.

A fuel tank 141 is mounted on upper portions of the main frames 114 in such a manner so as to cover the upper side of the internal combustion engine 1. A seat 142 is located on the rear side of the fuel tank 141, and the seat 142 is supported on the rear frame. A tail lamp 143 is disposed on the rear side of the seat 142, and a rear fender 144 for covering the upper side of the rear wheel 131 is disposed on the lower side of the tail lamp 143.

The motorcycle 100 may include a resin-made body cover 150 for covering the vehicle body. The body cover 150 includes a front cover 151 continuously covering an area ranging from the front side of the body frame 111 to a front portion of the internal combustion engine 1, and a rear cover 152 covering the lower side of the seat 142. A pair of left and right mirrors 153 are attached to upper portions of the front cover 151. In addition, a front fender 146 for covering the upper side of the front wheel 117 is mounted to the front fork 116.

Figure 2:
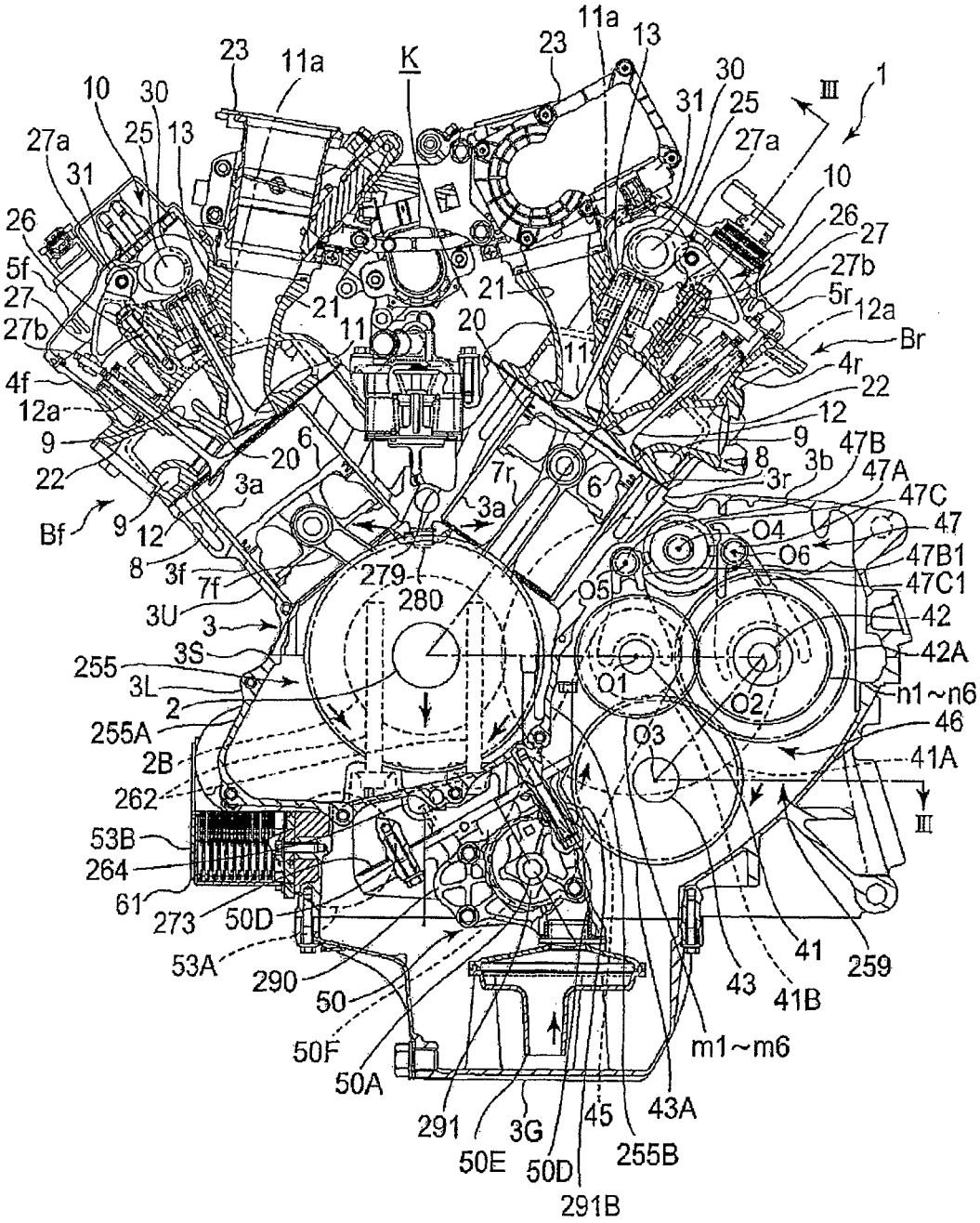
FIG. 2 is a sectional view of the internal combustion engine.

FIG. 2 is a side view of the internal combustion engine 1. In the following description referring to FIG. 2, the upper and lower sides in the figure will be taken as the upper and lower sides of the internal combustion engine 1, the left side in the figure as the front side of the internal combustion engine 1, and the right side in the figure as the rear side of the internal combustion engine 1.

A V bank space K, which is a space formed in the shape of capital V in a side view, is formed between the front bank Bf and the rear bank Br.

The crankcase 3 is formed to be splittable into upper and lower portions, namely, an upper crankcase 3U and a lower crankcase 3L. The crankshaft 2 is rotatably borne in the manner of being clamped between the crankcases 3U and 3L. A front cylinder block 3*f* having two cylinders arranged on the left and right sides and a rear cylinder block 3*r* having two cylinders arranged on the left and right sides are formed integrally with the upper crankcase 3U, in the state of extending skewly upward to be V-shaped as a whole in side view.

Oil pan 3G for reserving oil for the internal combustion engine 1 is provided at a lower portion of the lower crankcase 3L so as to bulge to the lower side. Oil pump 50 for circulating the oil in the internal combustion engine 1 is located on the lower side of the crankcase 2 inside the lower crankcase 3L.

A front cylinder head 4*f* oriented toward a front upper side is stacked on and fastened to the front cylinder block 3*f* by fastening bolts (not shown), and the upper side of the front cylinder head 4*f* is covered with a front cylinder head cover 5*f*. Similarly, a rear cylinder head 4*r* oriented toward a rear upper side is stacked on and fastened to the rear cylinder block 3*r* by fastening bolts (not shown), and the upper side of the rear cylinder head 4*r* is covered with a rear cylinder head cover 5*r*.

The front cylinder block 3*f* and the rear cylinder block 3*r* are each provided with cylinder bores 3*a*. In each of the cylinder bores 3*a*, a piston 6 is disposed to be reciprocated in the cylinder bore 3*a*. Each of the pistons 6 is connected to the crankshaft 2, which is provided singly and in common for the pistons 6, through a connecting rod 7*f*, 7*r*.

In addition, each of the cylinder blocks 3*f* and 3*r* is provided with a water jacket 8 through which cooling water for cooling each of the cylinder blocks 3*f* and 3*r* flows. The water jackets 8 are provided so as to surround the cylinder bores 3*a*.

Each of the front cylinder head 4*f* and the rear cylinder head 4*r* is provided with combustion chambers 20 (which are located at the upper side in the cylinder bores 3*a*), intake ports 21, and exhaust ports 22. To each of the intake ports 21, a throttle body 23 for controlling the quantity of a fuel-air mixture flowing into the intake port 2 is connected.

In addition, each of the cylinder heads 4*f* and 4*r* is provided with a water jacket 9 through which cooling water for cooling each of the cylinder heads 4*f* and 4*r* flows. The water jackets 9 are provided so as to surround the intake ports 21 and the exhaust ports 22.

In addition, in each of the cylinder heads 4*f* and 4*r*, a pair of intake valves 11 are arranged in an openable and closable manner in the state of being biased by valve springs 11*a* in directions (valve-closing directions) for closing the intake ports 21, and a pair of exhaust valves 12 are arranged in an openable and closable manner in the state of being biased by valve springs 12*a* in directions for closing the exhaust ports 22.

The intake valves 11 and the exhaust valves 12 are driven to open and close by a uni-cam type valve gears 10 in which the valves are driven by camshafts 25 arranged one for each of the cylinder heads 4*f*, 4*r*.

The valve gears 10 each include the camshaft 25 rotatably borne in the cylinder head 4*f*, 4*r* on the upper side of the intake valve 11, a rocker shaft 26 fixed to the cylinder head 4*f*, 4*r* with its axis set parallel to the camshaft 25, and a rocker arm 27 rockably supported on the rocker shaft 26.

The camshaft 25 has an intake cam 30 and an exhaust cam 31 projecting to the outer circumference side of the camshaft 25, and is rotated synchronously with the rotation of the crankshaft 2. The intake cam 30 and the exhaust cam 31 each have a cam profile in which the distance (radius) from the center to the outer circumference is not constant. The intake valve 11 and the exhaust valve 12 are moved up and down by variations in radius attendant on the rotation of the intake cam 30 and the exhaust cam 31.

In addition, a valve lifter 13 slidably fitted to each of the cylinder heads 4*f*, 4*r* on the lower side of the camshaft 25 is provided between the camshaft 25 and the intake valve 11.

A roller 27*a* making rolling contact with the exhaust cam 31 is provided at one end of the rocker arm 27 rotatably supported by the rocker shaft 26, and a tappet screw 27*b* abutting on the upper end of the exhaust valve 12 is screw engaged with the other end of the rocker arm 27 so that the advanced/retracted position thereof can be adjusted.

When the intake cam 30 and the exhaust cam 31 are rotated integrally with the camshaft 25, the intake cam 30 pushes the intake valve 11 downward through the valve lifter 13, and the exhaust cam 31 pushes the exhaust valve 12 downward through the rocker arm 27, whereby the intake port 21 and the exhaust port 22 are opened and closed at predetermined timings which are determined by the rotational phases of the intake cam 30 and the exhaust cam 31.

Figure 3:
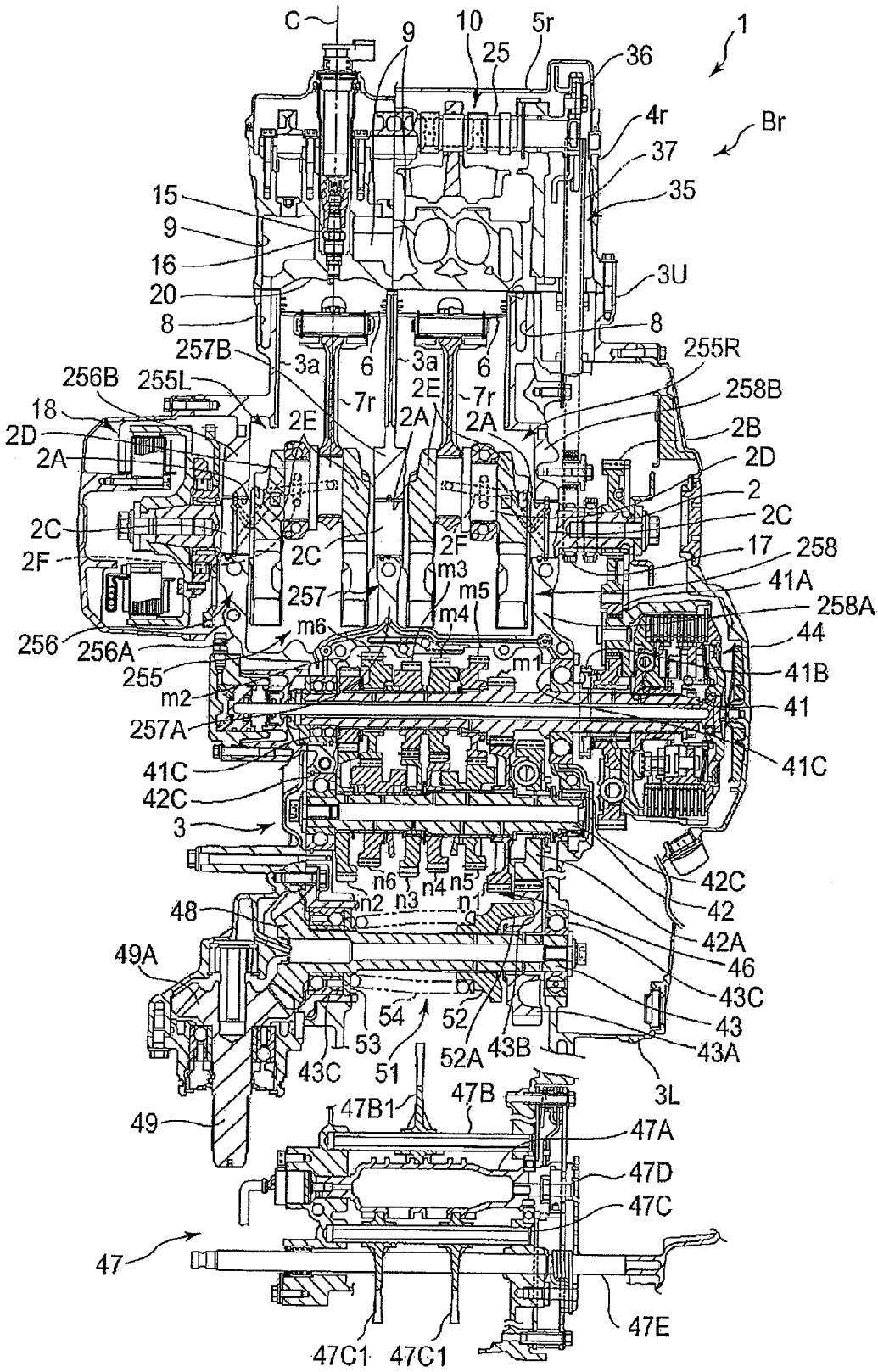
FIG. 3 is a sectional view taken along line of FIG. 2.

FIG. 3 is a sectional view taken along line of FIG. 2. While a section of the rear bank Br is shown in FIG. 3, the inside of the front bank Bf is configured in the same manner as the inside of the rear bank Br. Therefore, a description of the front bank Bf will be omitted.

As shown in FIG. 3, each of the cylinders in the cylinder heads 4*r* is provided with a plug insertion hole 15 on a cylinder axis C, which is the center axis of the cylinder bore 3*a*. A spark plug 16 (a spark plug for the cylinder on the right side is not shown) is disposed in the plug insertion hole 15, with its tip fronting on the inside of the combustion chamber 20.

The crankshaft 2 is rotatably supported inside the crankcase 3 through metal bearings 2A which are provided at both end portions and a central portion in the axial direction thereof.

A camshaft drive sprocket 17 for outputting the rotation of the crankshaft 2 is provided on one end side of the crankshaft 2. A cam chain chamber 35 extending vertically inside each of the banks Bf and Br is provided on the side of the camshaft drive sprocket 17 in the internal combustion engine 1. A driven sprocket 36 rotated as one body with the camshaft 25 is located inside the cam chain chamber 35, in the state of being fixed to one end of the camshaft 25. An endlessly form cam chain 37 is wrapped around the driven sprocket 36 and the camshaft drive sprocket 17, and the camshaft 25 is rotated at a rotating speed of one half that of the crankshaft 2, through the functions of the cam chain 37 and the driven sprocket 36.

In addition, a generator 18 is provided on the other end side of the crankshaft 2 as a generator.

A main shaft 41, a counter shaft 42, and an output shaft 43 are provided inside the crankcase 3 in parallel to the crankshaft 2. These shafts 41, 42, 43 inclusive of the crankshaft 2 constitute a gear transmission mechanism for transmitting the rotation of the crankshaft 2 in the sequence of the main shaft 41, the counter shaft 42, and the output shaft 43.

As shown in FIG. 3, the crankshaft 2 is disposed on a mating surface 3S between the upper crankcase 3U and the lower crankcase 3L. The main shaft 41 is disposed on the rear side of the crankshaft 2, and the counter shaft 42 is disposed on the rear side of the main shaft 41. The main shaft 41 and the counter shaft 42 are disposed on the mating surface 3S. In addition, the output shaft 43 is disposed on the front and lower side of the counter shaft 42. Thus, the axis centers O1 and O2 of the main shaft 41 and the counter shaft 42 are located at front and rear positions on the mating surface 3S, whereas the axis center O3 of the output shaft 43 is located on the rear side of the axis center O1 of the main shaft 41 and on the front and lower side of the axis center O2 of the counter shaft 42.

FIG. 3 is a sectional view along a section which interconnects the rear bank Br, the crankshaft 2, the main shaft 41, the counter shaft 42, and the output shafts 43 by straight lines.

A crank-side drive gear 2B for rotating the main shaft 41 is fixed to an end on the cam chain chamber 35 side of the crankshaft 2. The crank-side drive gear 2B is in mesh with a main shaft-side driven gear 41A on the main shaft 41. The main shaft 41 is supported through bearings 41C provided at both ends thereof.

The main shaft-side driven gear 41A is provided on the main shaft 41 so as to be rotatable relative to the main shaft 41, and is connected to a clutch mechanism 44. By the operations of the clutch mechanism 44, the transmission of power between the crankshaft 2 and the main shaft 41 can be effected and can be interrupted.

In addition, the main shaft-side driven gear 41A is provided with an oil pump drive gear 41B for driving the oil pump 50 (see FIG. 2). The oil pump drive gear 41B is rotated as one body with the main shaft-side driven gear 41A, independently of the engagement/disengagement of the clutch mechanism 44. As shown in FIG. 2, the oil pump drive gear 41B transmits the rotation of the crankshaft 2 to a driven gear 50F fixed to a drive shaft 50A of the oil pump 50 by way of a drive chain 45, thereby driving the oil pump 50.

As shown in FIG. 3, the counter shaft 42 is supported by bearings 42C provided at both ends thereof. A group of speed change gears are provided between the counter shaft 42 and the main shaft 41, to constitute a transmission 46. In more detail, drive gears m1 to m6 for six speeds are provided on the main shaft 41, and driven gears n1 to n6 for six speeds are provided on the counter shaft 42. The drive gears m1 to m6 and the driven gears n1 to n6 are meshed with each other on the basis of each gear speed, to constitute speed change gear pairs (combinations of gears) corresponding to the gear speeds, respectively. In addition, the speed change gear pairs decrease in reduction gear ratio (increase in gear speed) in the order of the first speed to the sixth speed. The first-speed gear pair m1, n1 having a greatest reduction gear ratio is disposed on one end side of the main shaft 41 on which the main shaft-side driven gear 41A is supported, and the second-speed gear pair m2, n2 is disposed on the other end side. Fifth-speed gear pair m5, n5, fourth-speed gear pair m4, n4, third-speed gear pair m3, n3 and sixth-speed gear pair m6, n6 are arranged between the first-speed gear pair m1, n1 and the second-speed gear pair m2, n2, in this order from the one end side.

The third-speed drive gear m3 and the fourth-speed drive gear m4 on the main shaft 41 are integrally spline-connected to the main shaft 41, and can be selectively engaged with and disengaged from the adjacent fifth-speed drive gear m5 or sixth-speed drive gear m6, by moving in the axial direction as shifter. The fifth-speed driven gear n5 and the sixth-speed driven gear n6 on the counter shaft 42 are individually spline-connected to the counter shaft 42, and can be engaged with and disengaged from the adjacent fourth-speed driven gear n4 or the third-speed driven gear n3, by moving in the axial direction as shifter.

The third-speed drive gear m3 and the fourth-speed drive gear m4 provided on the main shaft 41 so as to serve as shifter and the fifth-speed driven gear n5 and the sixth-speed driven gear n6 provided on the counter shaft 42 are moved by a gear shift mechanism 47 (see FIG. 2), whereby a gear shift is carried out.

As shown in FIG. 2, the gear shift mechanism 47 has a shift drum 47A parallel to the shafts 41 to 43. The shift drum 47A is coupled to a shift spindle (also called a shift shaft) 47E (see FIG. 3) through a ratchet mechanism 47D (see FIG. 3) for controlling the rotating amount of the shift drum 47A. A change pedal (not shown) for the driver to perform a gear shift operation therewith is attached to an end portion (an end portion on the left side of the vehicle body) of the shift spindle 47E, and, attendant on a gear shift operation on the change pedal, the shift spindle 47E is turned, to turn the shift drum 47A through the ratchet mechanism 47D.

The shift drum 47A is disposed between and on the upper side of the main shaft 41 and the counter shaft 42 so that its axis O4 is located on the rear side relative to the axis O3 of the output shaft 43. On the front and rear sides of the shift drum 47A, fork shafts 47B and 47C are disposed in parallel to the shift drum 47A. The fork shaft 47B is disposed on the front side of the shift drum 47A so that its axis O5 is located slightly below the axis O4 of the shift drum 47A. The fork shaft 47C is disposed on the rear side of the shift drum 47A so that its axis O6 is located at substantially the same height as the axis O4 of the shift drum 47A.

A shift fork 47B1 engaged with the shifter on the main shaft 41 is supported on the fork shaft 47B, and a shift fork 47C1 engaged with the shifter on the counter shaft 42 is supported on the fork shaft 47C. The speed change gear pair is changed by moving the shift forks 47B1 and 47C1 of the gear shaft mechanism 47, and the rotation of the main shaft 41 is transmitted to the counter shaft 42 through the speed change gear pair after the gear shift. As shown in FIG. 3, the counter shaft 42 is provided with an intermediate drive gear 42A for transmitting the rotation of the counter shaft 42 to the output shaft 43.

The output shaft 43 is supported by bearings 43C provided at both ends of the counter shaft 42, and is provided with a driven gear 43A which is meshed with the intermediate drive gear 42A. On the output shaft 43, a cam-type torque damper 51 is disposed adjacently to the driven gear 43A. The cam-type torque damper 51 damps a torque change upon generation of the torque change, and has a cylindrical member 52 which is spline-connected to the output shaft 43 so as to be movable in the axial direction. The cylindrical member 52 is provided, at its end face on the side of the driven gear 43A, with a projected cam 52A engaged with a recessed cam 43B formed in the driven gear 43A. A spring holder member 53 is fixed to a substantially central portion of the output shaft 43, a coil spring 54 is provided between the cylindrical member 52 and the spring holder member 53, and the cylindrical member 52 is biased against the driven gear 43A. The cam-type torque damper 51 is composed of the cylindrical member 52, the spring holder member 53 and the coil spring 54.

The output shaft 43 is integrally provided with a drive bevel gear 48 at a left end portion thereof. The drive bevel gear 48 is meshed with a driven bevel gear 49A provided integrally at the front end of a drive shaft 49, which extends in the front-rear direction of the vehicle body. This configuration ensures that the rotation of the output shaft 43 is transmitted to the drive shaft 49.

The internal layout of the internal combustion engine 1 will be described referring to FIG. 2.

In the internal combustion engine 1, the main shaft 41 is disposed on the rear side of the crankshaft 2, and the counter shaft 42 is disposed on the rear side of the main shaft 41. Therefore, the crankshaft 2, the main shaft 41 and the counter shaft 42 are arranged in this order from the front side toward the rear side. Accordingly, the vertical length of the crankcase 3 can be suppressed to a small value. In this configuration, even if the main shaft-side driven gear 41A fixed to the main shaft 41 is large in diameter, the main shaft-side driven gear 41A does not protrude upward, as compared with the case where a main shaft is disposed on the upper side of a crankshaft and a counter shaft. This ensures that the crankcase 3 can be restrained from protruding to the upper side. Accordingly, accessories can be arranged between the rear bank Br and an upper surface 3*b* of the crankcase 3.

Further, the main shaft 41 and the counter shaft 42 are disposed on the mating surface 3S between the upper and lower crankcases 3U and 3L. Therefore, the bearings 41C and 42C for the main shaft 41 and the counter shaft 42 are simplified in structure. Accordingly, the assembly of the main shaft 41 and the counter shaft 42 is facilitated.

Since the output shaft 43 is disposed on the front side of the counter shaft 42, the length of the crankcase 3 in the front-rear direction can be suppressed to a small value, as compared with the case where the output shaft 43 is disposed on the rear side of the counter shaft 42. The output shaft 43 is disposed on the lower side of the counter shaft 42, and the output shaft 43 as well as the main shaft 41 and the counter shaft 42 is disposed at one of vertexes of a triangle. Thus, the output shaft 43 is arranged by effectively utilizing a space between the main shaft 41 and the counter shaft 42. Therefore, it is possible to restrain the downward protrusion of the crankcase 3 due to the arrangement of the output shaft 43 on the front side of the counter shaft 42. Accordingly, while suppressing the front-rear length of the crankcase 3 to a small value, the vertical length of the crankcase 3 can also be suppressed to a small value. Consequently, the internal combustion engine 1 can be reduced in size and weight.

Since the front-rear length of the crankcase 3 is thus suppressed to a small value, the wheel base is made shorter. Therefore, it is possible to make compact the motorcycle 100 (see FIG. 1) and to enhance the turning performance of the motorcycle 100.

Since the shift drum 47A is disposed between and on the upper side of the main shaft 41 and the counter shaft 42, the length of the crankcase 3 in the front-rear direction can be suppressed to a small value, as compared with the case where the shift drum 47 is disposed on the rear side of the counter shaft 42. Since the shift drum 47A as well as the main shaft 41 and the counter shaft 42 is disposed at one of the vertexes of a triangle and the shift drum 47A is arranged by effectively utilizing the space between the main shaft 41 and the counter shaft 42, it is possible to restrain the upward protrusion of the crankcase 3 due to the arrangement of the shift drum 47A on the upper side of the main shaft 41 and the counter shaft 42, and it is possible to make smaller the vertical length of the crankcase 3. Therefore, accessories can be arranged between the rear bank Br and the upper surface 3*b* of the crankcase 3. In addition, since the distances from the shift drum 47A to the main shaft 41 and the counter shaft 42 can be made shorter, the shift forks 47B1 and 47C1 supported on the fork shafts 47B and 47C can be made shorter, which permits the internal combustion engine 1 to be reduced in size and weight.

Since the shift drum 47A is so disposed that its axis O4 is located on the rear side of the axis O3 of the output shaft 43, the vertical length of the crankshaft 3 can be suppressed to a small value, as compared with the case where the axis of the shift drum and the axis of the output shaft are aligned in the vertical direction. Consequently, accessories can be arranged between the rear bank Br and the upper surface 3*b* of the crankcase 3.

In addition, since the fork shaft 47B as well as the main shaft 41 and the shift drum 47A is disposed at one of the vertexes of a triangle and the fork shaft 47B is arranged by effectively utilizing the space between the main shaft 41 and the shift drum 47A, it is possible to restrain the upward protrusion of the crankcase 3 due to the arrangement of the fork shaft 47B on the upper side of the main shaft 41, and to suppress the vertical length of the crankcase 3 to a small value. This permits accessories to be arranged between the rear bank Br and the upper surface 3*b* of the crankcase 3. In addition, since the distances from the fork shaft 47B to the main shaft 41 and the shift drum 47A can be made shorter, the shift fork 47B1 supported on the fork shaft 47B can be made shorter, which permits the internal combustion engine 1 to be reduced in size and weight.

Similarly, since the fork shaft 47C as well as the counter shaft 42 and the shift drum 47A is disposed at one of the vertexes of a triangle and the fork shaft 47C is arranged by effectively utilizing the space between the counter shaft 42 and the shift drum 47A, it is possible to restrain the upward protrusion of the crankcase 3 due to the arrangement of the fork shaft 47C on the upper side of the counter shaft 42, and to suppress the vertical length of the crankcase 3 to a small value. This makes it possible to arrange accessories between the rear bank Br and the upper surface 3*b* of the crankcase 3. In addition, since the distances from the fork shaft 47C to the counter shaft 42 and the shift drum 47A can be made shorter, the shift fork 47C1 supported on the fork shaft 47C can be made shorter, which permits the internal combustion engine 1 to be reduced in size and weight.

As shown in FIG. 2, oil strainer 50E is disposed at a lower portion of the oil pump 50 so as to be immersed in the oil inside the oil pan 3G. The oil sucked into the oil pump 50 is filtered when passing through the oil strainer 50E. The oil in the oil pan 3G is discharged from the oil pump 50, and passes through oil passages formed inside the internal combustion engine 1, to be supplied to individual portions of the internal combustion engine 1.

In addition, the oil filter 53A and the oil cooler 53B formed to bulge from the lower crankcase 3L are provided on the lower side of the front cylinder block 3*f*.

Figure 4:
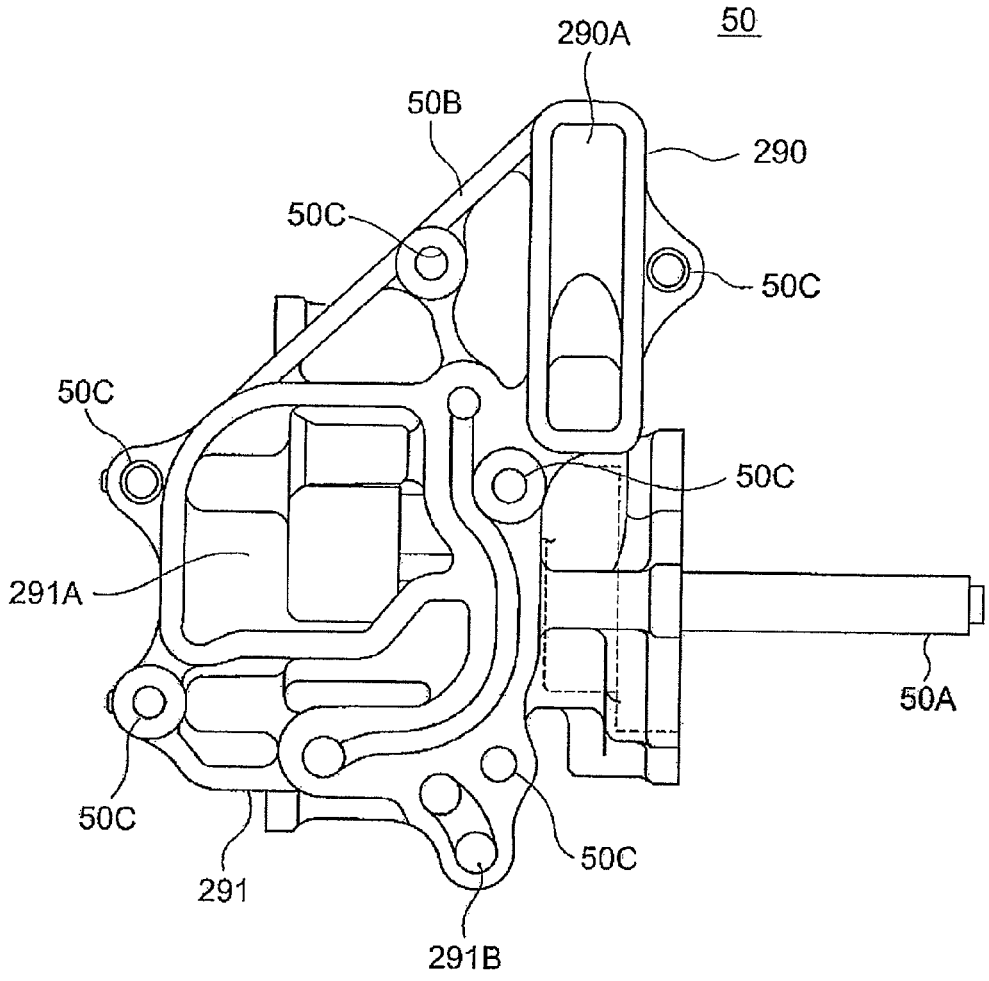
FIG. 4 is a top plan view of oil pump.

FIG. 4 is a top plan view of the oil pump 50.

The oil pump 50 has a configuration in which a feed pump 290 for supplying the oil to the crankshaft 2 and the valve gears 10, etc. and a scavenging pump 291 for discharging the oil present in crank chambers 255 (see FIG. 2) are provided integrally. The feed pump 290 and the scavenging pump 291 are trochoid pumps which are coaxially provided by using the drive shaft 50A in common, and are driven by the single drive shaft 50A extending toward the right side of the vehicle body.

In addition, an upper surface of the oil pump 50 is formed as a flat mounting surface 50B. The upper surface of the oil pump 50 is provided at its edge portions with a plurality of fixing holes 50C penetrating the mounting surface 50B, and the oil pump 50 is fixed to a lower portion of the crank chambers 255 through a plurality of bolts 50D (see FIG. 2) which are inserted in the fixing holes 50C.

The scavenging pump 291 is located on the side opposite to the extending direction of the drive shaft 50A. The scavenging pump 291 has a scavenging suction port 291A opened in a rectangular shape in the upper surface thereof, and a scavenging discharge port 291B for jetting the oil upward is provided on the rear side of the scavenging suction port 291A.

The feed pump 290 is provided in its upper surface with a feed discharge port 290A (discharge port) for discharging the oil sucked from the oil pan 3G. The feed discharge port 290A is located on the front side relative to the scavenging suction port 291A and on the extending side of the drive shaft 50A.

As shown in FIGS. 2 and 3, in the internal combustion engine 1, each of the front cylinder block 3*f* and the rear cylinder block 3*r* has two cylinder bores 3*a* aligned in the vehicle width direction. Each of the cylinder bores 3*a* communicates with the crank chamber 255 in which the crankshaft 2 is accommodated. The crank chambers 255 are provided as independent chambers in the manner of being bisected into left and right chambers, namely, a one-side crank chamber 255R (independent crank chamber) communicating with the front and rear cylinder bores 3*a* on one side (the right side in the vehicle width direction) and an other-side crank chamber 255L (independent crank chamber) communicating with the front and rear cylinder bores 3*a* on the other side (the left side in the vehicle width direction).

In addition, a wall part between the front cylinder block 3*f* and the rear cylinder block 3*r* on the upper side of the crank chambers 255 is provided with a sub gallery 279 as oil passage communicating with the inside of each of the cylinder heads 4*f*, 4*r*. The sub gallery 279 communicates also with piston jets 280 provided at upper portions in the crank chambers 255. The oil supplied to the piston jets 280 is sprayed onto each piston 6.

The crankshaft 2 has journal parts 2C which are supported on the crankcase 3, crank pins 2D which are provided eccentrically relative to the journal parts 2C and to which the connecting rods 7*f* and 7*r* are connected respectively, and crank webs 2E which interconnect the journal parts 2C and the crank pins 2D.

The crank pins 2D are provided one in each of the one-side crank chamber 255R and the other-side crank chamber 255L. The crank webs 2E are provided respectively on both sides of each crank pin 2D. The journal parts 2C are located at both ends and the center of the crankcase 3, and are rotatably borne respectively on the bearing parts formed on the crankcase 3. In addition, the crankshaft 2 is provided with a plurality of in-shaft oil passages 2F for establishing communication between the journal parts 2C and the crank pins 2D.

The crank chamber 255 is a space formed by combining the upper crankcase 3U and the lower crankcase 3L. As shown in FIGS. 2 and 3, in the front-rear direction, the space is partitioned by a front wall 255A located on the lower side of the front bank Bf and a rear wall 255B located on the lower side of the rear bank Br. In the vehicle width direction, the space is partitioned by support walls 256, 257, and 258 in this order from the side of the generator 18. The support wall 257 is an inner wall which is located at the center of the crank chamber 255 and by which the one-side crank chamber 255R and the other-side crank chamber 255L are partitioned from each other to the left and right sides. The support walls 256, 257, and 258 are provided integrally with the crankcase 3.

Figure 5:
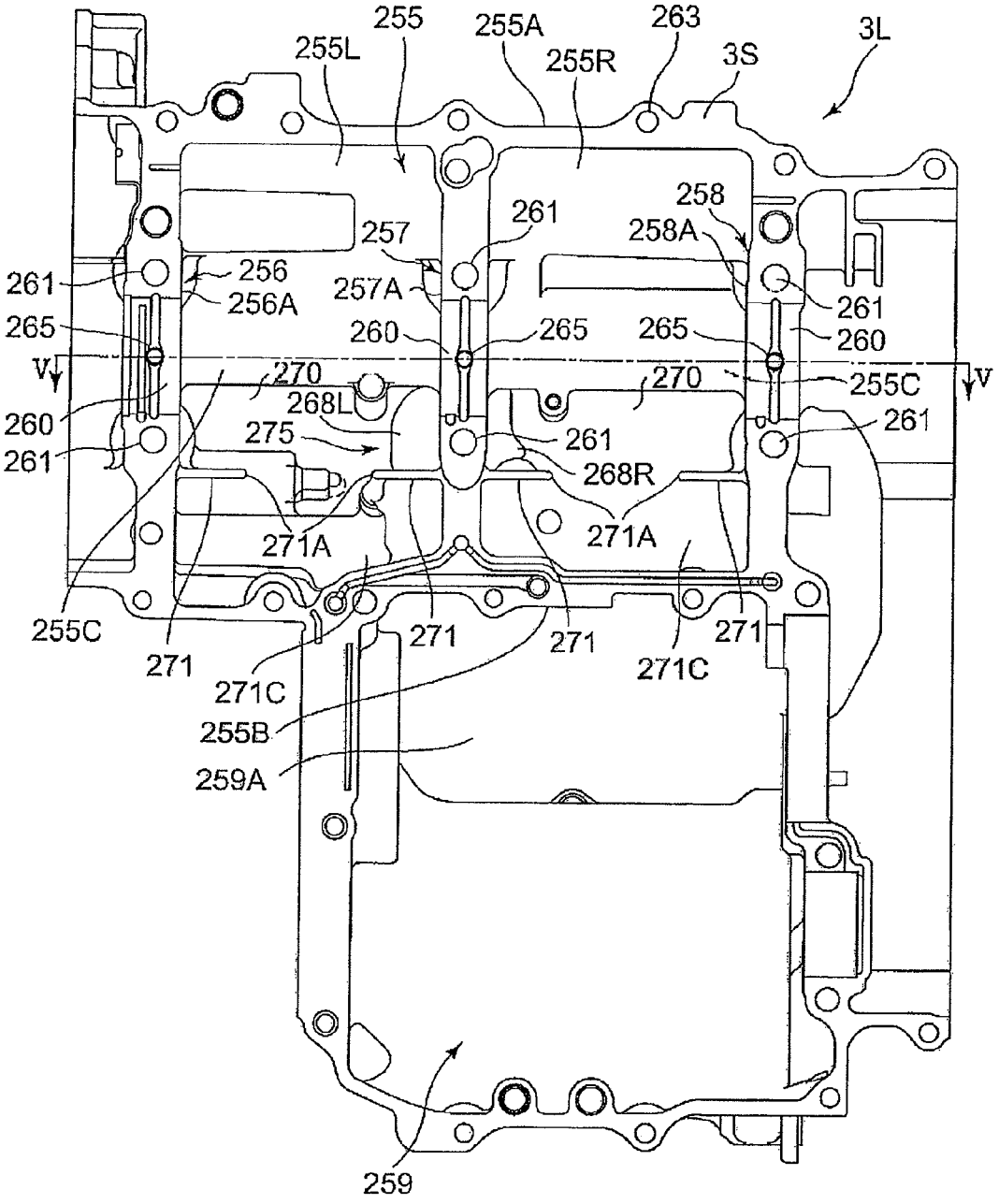
FIG. 5 is a top plan view of a lower crankcase.
Figure 6:
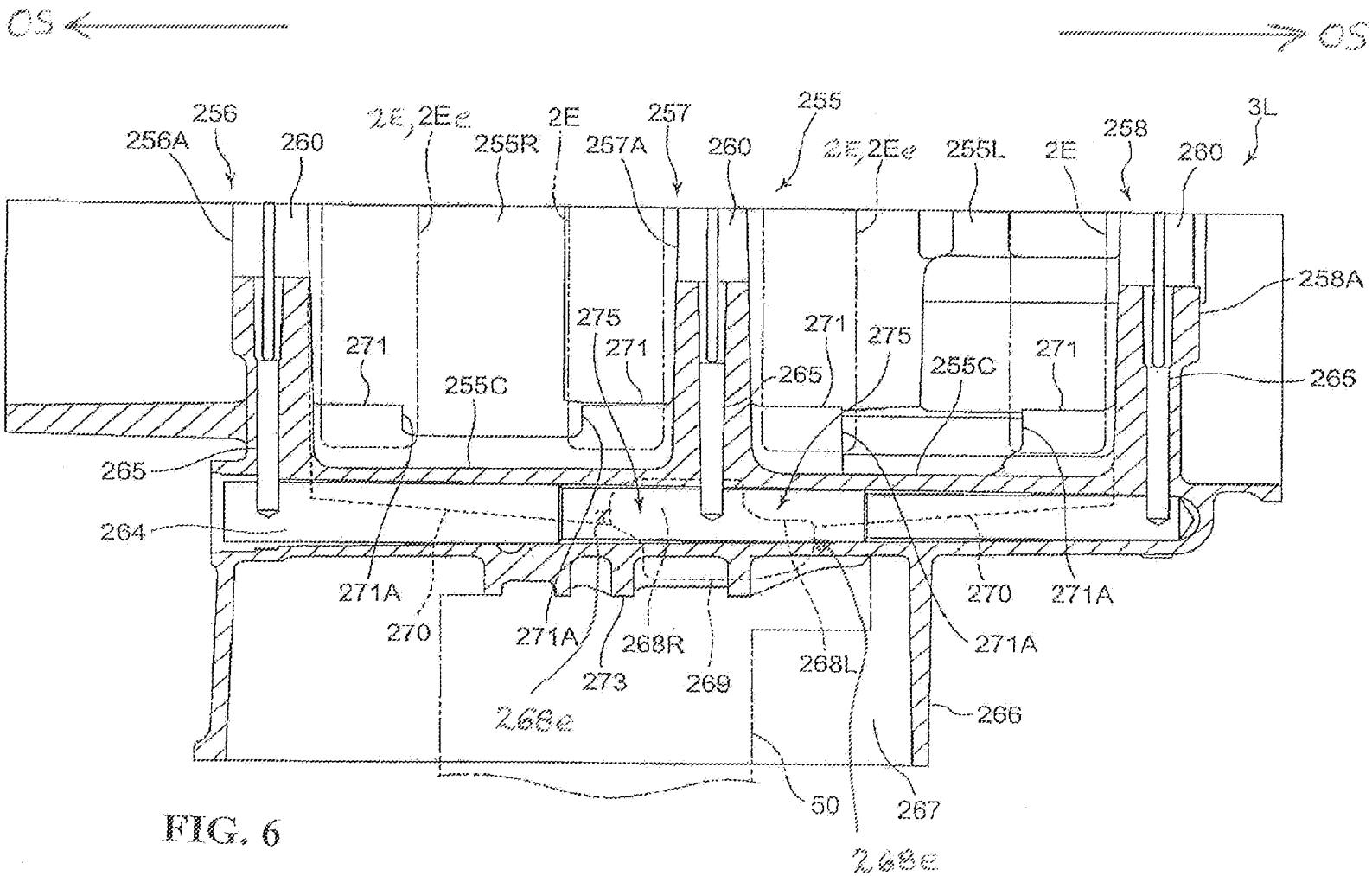
FIG. 6 is a sectional view taken along line V-V of FIG. 5.

FIG. 5 is a top plan view of the lower crankcase 3L. FIG. 6 is a sectional view taken along line V-V of FIG. 5.

As shown in FIG. 5, an upper surface of the lower crankcase 3L is a mating surface 3S for mating with the upper crankcase 3U. In upper part of the figure, the area surrounded by the mating surface 3S is a lower half of the crank chamber 255, and a lower half of a transmission chamber 259 accommodating the transmission 46 is provided on the rear side of the crank chamber 255. The transmission chamber 259 communicates with the oil pan 3G via an opening 259A formed at a front portion thereof. In addition, the mating surface 3S is provided with a plurality of bolt holes 263 penetrating the lower crankcase 3L, and the lower crankcase 3L is fastened and fixed to the upper crankcase 3U by bolts (not shown) inserted in the bolt holes 263.

The crank chamber 255 in the lower crankcase 3L is formed in a roughly rectangular shape in plan view, and is partitioned into the one-side crank chamber 255R and the other-side crank chamber 255L by the support wall 257 erected at the center in the width direction.

As shown in FIGS. 3 and 5, the support walls 256, 257, 258 are formed by coupling lower support walls 256A, 257A, 258A provided in the lower crankcase 3L with upper support walls 256B, 257B, 258B provided in the upper crankcase 3U, respectively. Thus, the one-side crank chamber 255R and the other-side crank chamber 255L are spaces which are partitioned from each other by the support wall 257 extending vertically at the center of the crank chamber 255 and which are substantially sealed, without communicating with each other.

As shown in FIG. 5, each of upper surfaces of the lower support walls 256A, 257A, 258A is provided, at its central portion in the front-rear direction, with a recessed part 260 constituting about one half of the bearing part. In addition, each of lower surfaces of the upper support walls 256B, 257B, 258B is also provided with a recessed part (not shown) constituting about one half of the bearing part.

Further, in the vicinity of each recessed part 260, bolt holes 261 vertically penetrating the lower crankcase 3L are formed respectively on the front and rear sides of the recessed part 260. As shown in FIG. 2, a crankshaft fixing bolt 262 (journal bolt) for fixing the crankshaft 2 by fastening together the lower crankcase 3L and the upper crankcase 3U in the vicinity of the crankshaft 2 is inserted in each bolt hole 261.

As shown in FIGS. 5 and 6, a main gallery 264 (see FIG. 6) as oil passage extending in the vehicle width direction in a wall part of the lower crankcase 3L is formed on the lower side of a bottom portion 255C (lower inner wall) of the crank chamber 255. The main gallery 264 is located directly under the recessed parts 260, and each of the recessed part 260 is provided therein with a crankshaft oil passage 265 communicating with the main gallery 264.

In addition, oil pan connection part 266 erected downward in a frame-like shape is provided on the lower side of the crank chamber 255. The inside of the oil pan connection part 266 is a pump accommodating part 267 in which the oil pump 50 is accommodated.

FIGS. 5 and 6 illustrate an oil outflow hole (right outflow hole) 268R for establishing communication between the one-side crank chamber 255R and the pump accommodating part 267 is formed at a rear portion of the one-side crank chamber 255R. In addition, FIGS. 5 and 6 illustrate an oil outflow hole (left outflow hole) 268L for establishing communication between the other-side crank chamber 255L and the pump accommodating part 267 is formed at a rear portion of the other-side crank chamber 255L. FIG. 5 illustrates a top-down view of the lower crank case 3L. As can be seen in FIG. 5, each of the right and left outflow holes 268R, 268L extends in a front-to-rear direction of the engine 1 from a position directly under the crankshaft 2 (supported in the recessed parts 260 of the crankshaft 3L to a position rearward with respect to where the crankshaft 2 is located. Further, FIG. 5 shows that each of the right and left outflow holes 268R, 268L extends further in the front-to-rear direction of the engine 1 than in a width direction of the engine 1. FIG. 5 also illustrates six bolt holes 261 for accommodating crankshaft bolts 262 for fixing crankshaft 2 by fastening together lower case 3L and upper case 3U, and illustrates each of the right and left outflow holes 268R, 268L extending further in the rearward direction of the engine 1 than each of the bolt holes 261 located rearwardly of the crankshaft 2.

The oil outflow holes 268R and 268L are provided at the center of the crank chamber 255 along the lower support wall 257A, are formed at substantially the same position in the front-rear direction, and join each other on the lower side of the lower support wall 257A, to be an oil discharge port 269 for discharging the oil to the side of the pump accommodating part 267. The oil outflow holes including a left outflow hole 268L and a right outflow hole 268R respectively located adjacent to left and right sides of the lower support wall 257A of the inner wall 257. As can be seen in FIG. 6, the left outflow hole 268L is formed with an end 268*e* projecting toward a left outer side OS in a vehicle width direction and inwardly the vehicle width direction relative to the end 2Ee of the left crank web 2Ee. Likewise, the right outflow hole 268R is formed with an end 268*e* projecting toward a right outer side OS in the vehicle width direction, and inwardly in the vehicle width direction relative to the end 2Ee of the right crank web 2E.

A slant part 270 slanted downward from the side of the lower support walls 256A and 258A toward the central lower support wall 257A is formed at the bottom portion 255C in the vicinity of the oil outflow holes 268R and 268L. In other words, the oil flowing into the crank chamber 255 flows along the slant part 270, to be led into the oil outflow holes 268R, 268L.

In addition, oil slinger ribs 271 projecting upwardly from the bottom portion 255C are formed at rear portions of the one-side crank chamber 255R and the other-side crank chamber 255L. As shown in FIG. 6, the oil slinger ribs 271 are formed two for each of the one-side crank chamber 255R and the other-side crank chamber 255L, correspondingly to the positions of the crank webs 2E. More in detail, the oil slinger ribs 271 are formed along inner side surfaces of the lower support walls 256A, 258A and both side surfaces of the lower support wall 257A, and the tips 271A in the vehicle width direction of the oil slinger ribs 271 are located on the inner sides so as not to protrude beyond the ends of the crank webs 2E. Further, portions between the tips 271A are formed to be lower than the oil slinger ribs 271, so as to avoid large end portions of the connecting rods 7*f*, 7*r*.

Figure 7:
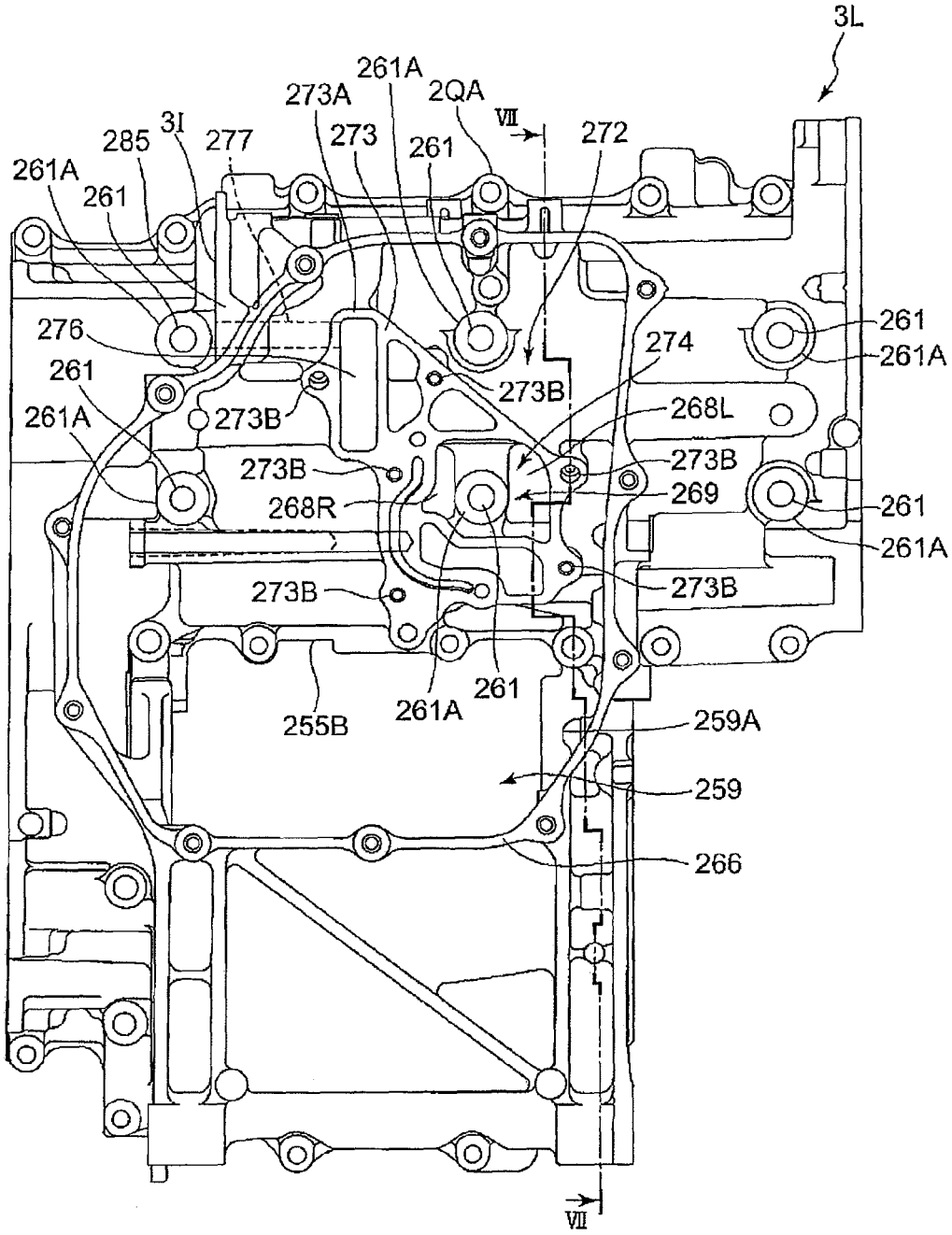
FIG. 7 is a bottom plan view of the lower crankcase.
Figure 8:
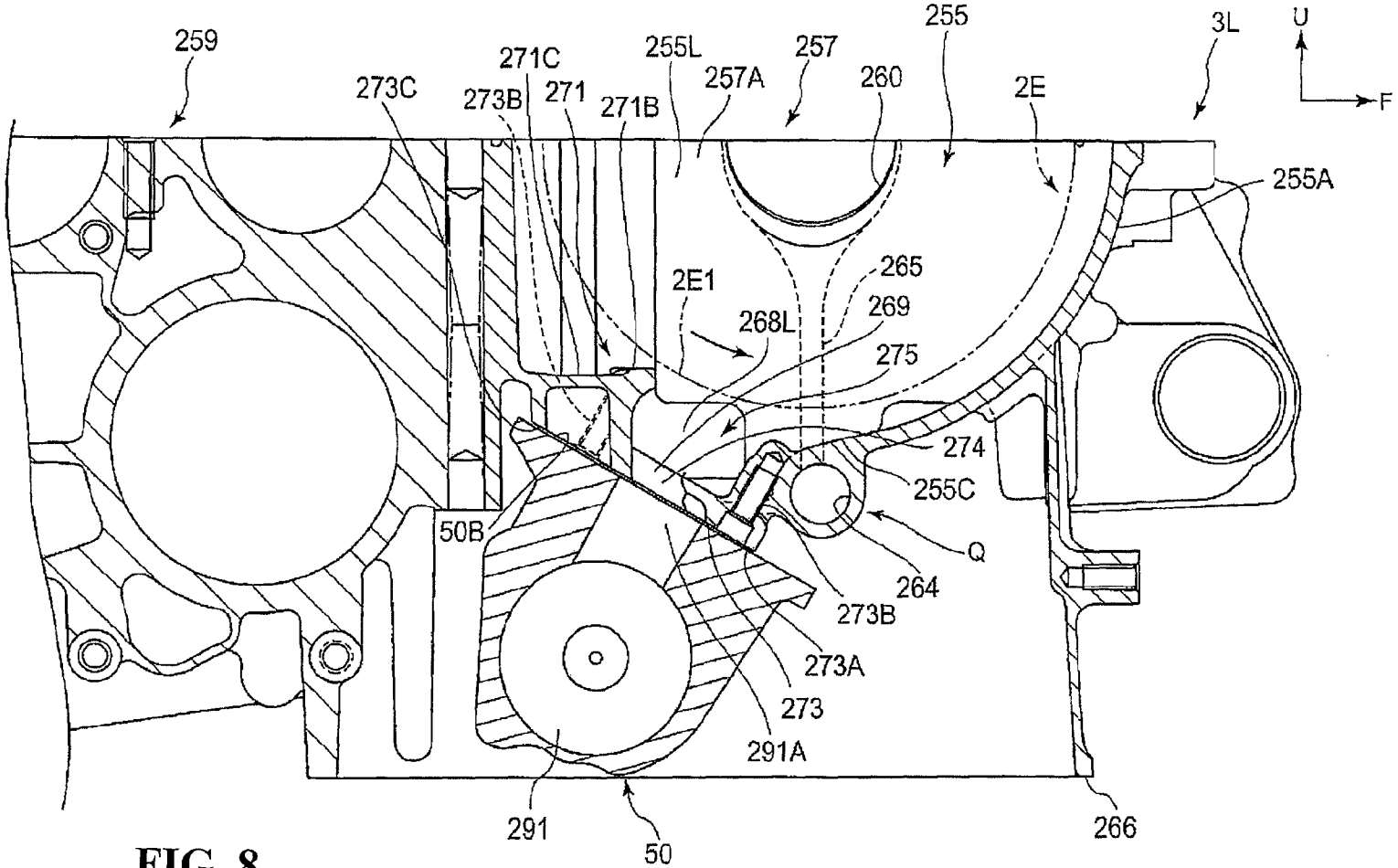
FIG. 8 is a sectional view taken along line VII-VII of FIG. 7.

FIG. 7 is a bottom plan view of the lower crankcase 3L. FIG. 8 is a sectional view taken along line VII-VII of FIG. 7. FIG. 8 shows a section in the vicinity of the oil outflow hole 268L in the other-side crank chamber 255L together with the oil pump 50. In FIG. 8, arrow F indicates the front side of the vehicle body, and arrow U the upper side of the vehicle body.

As shown in FIG. 7, in the condition where the oil pan 3G has been removed, an outer wall 272 (crank chamber outer walls) of the bottom portion 255C of the crank chamber 255 is exposed on the inner side of the oil pan connection portion 266. The outer wall 272 inside the oil pan connection portion 266 is formed with oil pump mounting surface 273 on which to mount the oil pump 50 (see FIG. 2). The oil pump mounting surface 273 is provided with a suction port 274 which communicates with the oil outflow holes 268R, 268L and straddles the lower support wall 257A in the vehicle width direction. The scavenging suction port 291A of the scavenging pump 291 is connected to the suction port 274, and the oil in the crank chamber 255 is sucked into the scavenging pump 291 via the suction port 274.

In this embodiment, a so-called dry sump lubrication system is used in which the oil in the crank chamber 255 is sucked out by the scavenging pump 291 so that the oil does not collect or stagnate in the crank chamber 255. Therefore, collision between the oil and the crank webs 2E is obviated, and, accordingly, the internal combustion engine 1 can be enhanced in efficiency and output.

In addition, a bearing surface 261A (mounting surface) for receiving a head portion of the crankshaft fixing bolt 262 is formed inside the suction port 274. This ensures that, even in such a layout that the crankshaft fixing bolt 262 would constitute an obstacle at the time of providing the scavenging pump 291 on the outer wall 272 in the manner of straddling the lower support wall 257A, the scavenging pump 291 can be disposed at a desired position for straddling the lower support wall 257A.

As shown in FIGS. 2 and 8, the oil pump mounting surface 273 is a slant surface of which a surface for contact with the mounting surface 50B of the oil pump 50 is formed in a flat shape and which is so slanted that its front portion 273A in the front-rear direction of the vehicle body is lower. In addition, the oil pump mounting surface 273 is provided with a plurality of fixing holes 273B in which the bolts 50D inserted in the fixing holes 50C are fastened.

As shown in FIG. 8, the bottom portion 255C of the crank chamber 255 is provided with a recessed part 275 recessed to the lower side, and the oil discharge port 269 is provided in the recessed part 275. The front wall 255A is slanted rearwardly downward, and the recessed part 275 is provided at the lowermost position of the bottom portion 255C, so that the oil deposited in the crank chamber 255 is efficiently collected into the recessed part 275.

The oil slinger rib 271 is formed as a rear wall of the recessed part 275, and the upper end 271B of the oil slinger rib 271 is provided in proximity to an outer peripheral surface 2E1 on the rear side of the crank web 2E. In the internal combustion engine 1, the crank web 2E is rotated counterclockwise as indicated by arrow in FIG. 8, and the circular arc-shaped outer peripheral surface 2E1 of the crank web 2E approaches the upper end 271B from above the oil slinger rib 271. When the outer peripheral surface 2E1 passes near the upper end 271B, the oil adhering to the outer peripheral surface 2E1 is scraped off by the upper end 271B. The oil thus scraped off by the upper end 271B is deposited on oil receiving part 271C located on the rear side of the oil slinger rib 271. The oil receiving part 271C is slanted downward so that the oil flows to the slant part 270 (see FIG. 6), and the oil flows from the oil receiving part 271C to the oil discharge port 269 by way of the slant part 270 on the lower side of the oil receiving part 271C. Therefore, the oil in the crank chamber 255 can be discharged efficiently.

While the oil slinger rib 271 near the oil outflow hole 268L has been described here, the other oil slinger ribs 271 are also configured in the same manner.

Further, the oil slinger rib 271 is provided over the oil pump mounting surface 273 having a rear portion 273C slanted rearwardly upward, and is provided at a high position in a bottom-raised manner. Therefore, the length of the oil slinger rib 271 can be shortened, and the strength of the oil slinger rib 271 can be enhanced.

In addition, the oil pump mounting surface 273 has a front portion 273A slanted forwardly downward. Consequently, a space Q is secured on the upper side of the front portion 273A of the oil pump mounting surface 273, and, by utilizing this space Q, oil passages and the like can be formed on the upper side of the oil pump mounting surface 273.

As shown in FIG. 7, oil passage inlet 276 to which the feed discharge port 290A of the feed pump 290 is connected is formed on the oil pump mounting surface 273 at a position on the front side relative to the suction port 274. The oil passage inlet 276 is in communication with a filter oil passage 277 (oil passage) for connecting the oil passage inlet 276 to the oil filter 53A. The filter oil passage 277 extends along the vehicle width direction in a wall part 285 on the lower side of the crank chamber 255, and communicates with a side wall 31 of the lower crankcase 3L to which the oil filter 53A is mounted.

Figure 9:
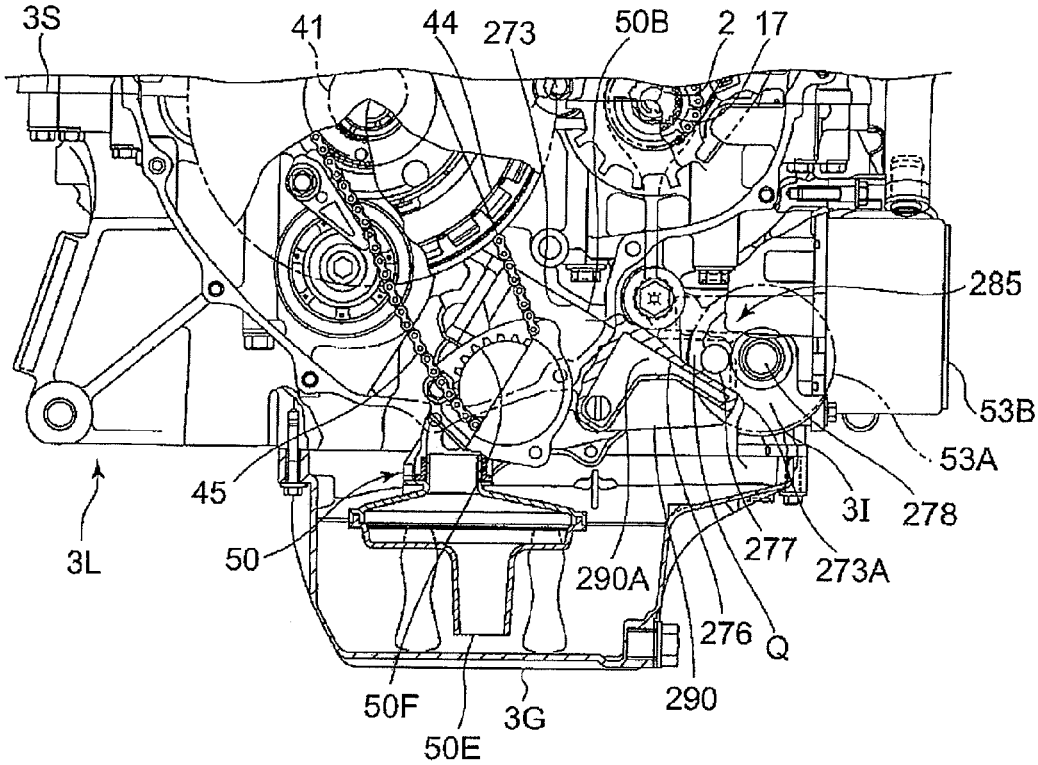
FIG. 9 is a partly broken sectional view, as viewed from the right side, of the vicinity of the lower crankcase.

FIG. 9 is a partly broken sectional view, as viewed from the right side, of the vicinity of the lower crankcase 3L.

As shown in FIG. 9, the oil filter 53A formed in a cylindrical shape is mounted to the side wall 31 of the lower crankcase 3L, and is connected to the filter oil passage 277. The side wall 31 is provided therein with a cooler oil passage 278 connected to the oil cooler 53B. The cooler oil passage 278 is provided adjacently to the filter oil passage 277, and the oil having passed through the oil filter 53A flows through the cooler oil passage 278, to reach the oil cooler 53B.

Since the filter oil passage 277 is thus formed by boring a hole in the wall part 285 of the lower crankcase 3L, there is no need for a component part such as a pipe for connection between the feed pump 290 and the oil filter 53A, and, therefore, the number of component parts can be reduced.

In addition, since the feed discharge port 290A is provided on the lower side of the oil pump mounting surface 273 and the oil passage inlet 276 is provided at a low position, the space Q (see FIG. 8) can be secured on the upper side of the oil passage inlet 276, and the filter oil passage 277 can be formed in the wall part 285.

Now, the flows of the oil in the internal combustion engine 1 will be described. The plurality of arrows shown in FIG. 2 indicate the flow directions of the oil.

The oil sucked up from the oil pan 3G by the feed pump 290 is discharged from the feed discharge port 290A (FIG. 9), and passes through the filter oil passage 277 to reach the oil filter 53A, where it is clarified. The clarified oil passes through the cooler oil passage 278 to reach the oil cooler 53B, where it is cooled. The cooler oil passage 278 has a branch oil passage (not shown) continued to the transmission 46, and a portion of the oil passing through the cooler oil passage 278 passes through the branch oil passage, to be supplied to the vicinity of the transmission 46.

The oil cooled by the oil cooler 53B passes through oil passage (not shown) formed in the lower crankcase 3L, to be supplied into the main gallery 264 (FIGS. 2 and 6). Then, the oil passes through the crankshaft oil passages 265, formed in the lower support walls 256A, 257A, 258A, to reach the bearing parts. The oil at the bearing parts is supplied into the in-shaft oil passage 2F in the crankshaft 2, to reach the crank pins 2D. A portion of the oil supplied to the bearing part of the lower support wall 257A reaches the sub gallery 279, through which it is supplied to the piston jets 280 and into the cylinder heads 4*f*, 4*r*.

The oil supplied to the cylinder heads 4*f*, 4*r*, the pistons 6, and the crankshaft 2, etc. lubricates these parts, then flows down through the one-side crank chamber 255R and the other-side crank chamber 255L, and collects in the recessed parts 275 at the bottom portion 255C. The portions of oil collected in the recessed parts 275 flow through the oil outflow holes 268R and 268L to join each other at the oil discharge port 269, and the joined oil is sucked into the scavenging suction port 291A.

The oil sucked into the scavenging suction port 291A by the scavenging pump 291 is jetted upward from the scavenging discharge port 291B, whereby it is supplied to the transmission 46 so as to lubricate the vicinity of the transmission 46. The oil thus supplied to the transmission 46 flows down in the transmission chamber 259, to return into the oil pan 3G.

Thus, in this embodiment, the oil outflow holes 268R and 268L in the one-side crank chamber 255R and the other-side crank chamber 255L provided independently from each other are provided along the lower support wall 257A; the oil discharge port 269 where both the oil outflow holes 268R and 268L join each other is provided in the outer wall 272 on the lower side of the lower support wall 257A in the manner of straddling the lower support wall 257A to constitute the suction port 274; and the oil pump 50 is directly fixed so that the scavenging suction port 291A thereof overlaps with the suction port 274. This ensures that the oil in the one-side crank chamber 255R and the other-side crank chamber 255L flows from the oil discharge port 269 directly into the scavenging suction port 291A. Therefore, a component part for gathering the oil present in the one-side crank chamber 255R and the other-side crank chamber 255L and causing the gathered oil to flow to the scavenging pump 291 is not needed. Accordingly, the number of component parts can be reduced. In addition, it suffices to provide only one scavenging pump 291 for the plurality of crank chambers, namely, the one-side crank chamber 255R and the other-side crank chamber 255L, which also contributes to a reduction in the number of component parts.

Since the oil pump 50 is mounted directly to the oil pump mounting surface 273 of the outer wall 272, assembleability of the oil pump 50 can be enhanced. More specifically, the oil pump 50 can be mounted by a simple procedure of bringing the mounting surface 50B of the oil pump 50 directly into contact with the oil pump mounting surface 273, and fastening the plurality of bolts 50D.

As has been described above, according to this embodiment of the present invention, the oil discharge port 269 is provided along the lower support wall 257A of the one-side crank chamber 255R and the other-side crank chamber 255L adjacent to each other, and the suction port 274 is provided directly in the outer wall 272 at the bottom portion 255C of the crank chamber 255 in the manner of straddling the lower support wall 257A. This structure ensures that the oil in the one-side crank chamber 255R and the other-side crank chamber 255L is directly supplied from the oil discharge port 269 to the scavenging pump 291. Therefore, a component part for gathering the portions of oil flowing from the plurality of oil outflow holes 268R and 268L and causing the gathered oil to flow to the scavenging pump 291 is not needed, and, accordingly, a reduction in the number of component parts and a simplified structure can be realized.

In addition, since the bearing surface 261A for the crankshaft fixing bolt 262 is formed in the suction port 274, it is ensures that even in a layout in which the crankshaft fixing bolt 262 would constitute an obstacle at the time of providing the scavenging pump 291 at the outer wall 272 in the manner of straddling the lower support wall 257A, the scavenging pump 291 can be disposed at a desired position such as to straddle the lower support wall 257A.

Since the oil adhering to the crank webs 2E can be removed by the oil slinger ribs 271, the crank webs 2E can be prevented from receiving a resistance by collision against the oil. Therefore, the internal combustion engine 1 can be enhanced in efficiency and output.

Further, since the filter oil passage 277 extending from the feed discharge port 290A of the feed pump 290 to the oil filter 53A is formed in the wall part 285, a component part for interconnecting the feed pump 290 and the oil filter 53A is not needed, so that the number of component parts can be reduced.

Since the oil slinger rib 271 is provided over the oil pump mounting surface 273 having the rear portion 273C inclined rearwardly upward and is provided at a high position in a bottom-raised manner, it is possible to shorten the length of the oil slinger rib 271 and to enhance the strength of the oil slinger rib 271. In addition, since the oil pump mounting surface 273 is so formed that its front portion 273A is slanted forwardly downward and the space Q is secured on the upper side of the oil pump mounting surface 273, it is possible, by utilizing the space Q, to form the filter oil passage 277 in the wall part 285 on the upper side of the oil pump mounting surface 273, and to lay out the oil passages efficiently.

In addition, the above-described embodiment is merely to exemplify one mode for carrying out the present invention, and the invention is not to be limited by the above embodiment.

While a configuration in which the suction port 274 is provided in the manner of straddling the lower support wall 257A partitioning the one-side crank chamber 255R and the other-side crank chamber 255L from each other has been described in the above embodiment, this configuration is not limitative of the present invention. For example, a configuration may be adopted in which yet another crank chamber is provided adjacently to the other-side crank chamber 255L, a suction port is provided in the manner of straddling a lower support wall partitioning the yet another crank chamber and the other-side crank chamber 255L from each other, and another scavenging pump is provided at the suction port.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-cylinder internal combustion engine comprising:

a plurality of independent crank chambers formed by partitioning a crankcase by a plurality of support walls which are provided integrally with the crankcase and support a crankshaft, the support walls are formed by coupling lower support walls provided in a lower crankcase with upper support walls provided in an upper crankcase respectively, and one of the support walls is an inner wall which is located between two of the crank chambers; and a plurality of oil outflow holes which respectively communicate with the crank chambers and through which oil is discharged from each of the crank chambers, the plurality of oil outflow holes including a left outflow hole and a right outflow hole respectively located adjacent to left and right sides of the lower support wall of the inner wall, the left outflow hole being formed with an end projecting toward a left outer side in a vehicle width direction, and the right outflow hole being formed with an end projecting toward a right outer side in the vehicle width direction, wherein each of the left and right outflow holes extends in a front-to-rear direction of the engine from a position directly under the crankshaft to a position rearward of journal bolts that are located rearward of a centerline of the crankshaft, and each of the right and left outflow holes extends further in the front-to-rear direction of the engine than in a width direction of the engine.

2. The multi-cylinder internal combustion engine according to claim 1, wherein a mounting surface for a journal bolt for fixing the crankshaft to the crankcase is formed in the scavenging suction port of the scavenging pump.

3. The multi-cylinder internal combustion engine according to claim 1, wherein a lower inner wall of the crankcase is provided with a recessed part including the oil discharge port, and with an oil slinger rib proximate to a peripheral surface of a crank web along the recessed part.

4. The multi-cylinder internal combustion engine according to claim 1, the engine further comprising:

an oil discharge port provided under a lower side of the lower support wall of the inner wall, that is adjacent to where the left and right outflow holes join each other, and a scavenging suction port of a scavenging pump for discharging the oil present in the crank chambers provided in a crank chamber outer wall in the manner of straddling the lower support wall of the inner wall, wherein the scavenging pump is directly fixed to the crank chambers so that the scavenging suction port overlaps with a suction port of the crank chambers.

5. The multi-cylinder internal combustion engine according to claim 3, wherein a feed pump by which oil in an oil pan is fed through an oil filter to each part to be supplied with the oil is provided coaxially with the scavenging pump, and an oil passage extending from a discharge port of the feed pump to the oil filter is formed in a crankcase wall.

6. The multi-cylinder internal combustion engine according to claim 1, the engine further comprising:

multiple bolt holes for accommodating crankshaft bolts for fixing the crankshaft by fastening together lower and upper cases of the crankcase, wherein each of the left and right outflow holes extends further in the rearward direction of the engine than each of the bolt holes located rearwardly of the crankshaft.

7. The multi-cylinder internal combustion engine according to claim 5, wherein an oil pump mounting surface is formed as a slant surface slanted against a front-rear direction at a lower portion of the crankcase, the oil slinger rib is provided on the upper side of the slant surface, and the discharge port of the feed pump is provided on the lower side of the slant surface.

8. The multi-cylinder internal combustion engine according to claim 6, wherein an oil pump mounting surface is formed as a slant surface slanted against a front-rear direction at a lower portion of the crankcase, the oil slinger rib is provided on the upper side of the slant surface, and the discharge port of the feed pump is provided on the lower side of the slant surface.

9. The multi-cylinder internal combustion engine according to claim 3, wherein a plurality of oil slinger ribs project upwardly from a bottom portion and are formed at rear portions of the crank chambers.

10. The multi-cylinder internal combustion engine according to claim 9, wherein the plurality of oil slinger ribs are formed along inner side surfaces of the lower support walls with tips in a width direction being located on inner sides to not extend beyond the crank webs.

11. A multi-cylinder internal combustion engine comprising:

left and right crank chambers formed by partitioning a crankcase by a plurality of support walls, the support walls are formed by coupling lower support wall portions provided in a lower crankcase with upper support wall portions provided in an upper crankcase respectively, and one of the support walls is an inner wall which is located at a center of the crankcase between the left and right crank chambers;

left and right oil outflow holes for respectively communicating with the crank chambers and through which oil is discharged from each of the crank chambers the left and right outflow holes respectively located adjacent to left and right sides of the lower support wall of the inner wall, the left outflow hole being formed with an end projecting toward a left outer side in a vehicle width direction, and the right outflow hole being formed with an end projecting toward a right outer side in the vehicle width direction;

wherein each of the left and right outflow holes extends in a front-to-rear direction of the engine from a position directly under the crankshaft to a position rearward of journal bolts that are located rearward of a centerline of the crankshaft, and each of the right and left outflow holes extends further in the front-to-rear direction of the engine than in a width direction of the engine.

12. The multi-cylinder internal combustion engine according to claim 11, wherein a mounting surface for a journal bolt for fixing the crankshaft to the crankcase is formed in the scavenging suction port of the scavenging pump.

13. The multi-cylinder internal combustion engine according to claim 11, wherein a lower inner wall of the crankcase is provided with a recessed part including the oil discharge port, and with an oil slinger rib proximate to a peripheral surface of a crank web along the recessed part.

14. The multi-cylinder internal combustion engine according to claim 11, the engine further comprising:

an oil discharge port provided under a lower side of lower support wall of the inner wall of the two crank chambers, which is adjacent to where the left and right outflow holes join each other; and a scavenging suction port of a scavenging pump for discharging the oil present in the crank chambers provided in a crank chamber outer wall in the manner of straddling the lower support wall of the inner wall, wherein the scavenging pump is directly fixed to the crank chambers so that that the scavenging suction port overlaps with a suction port of the crank chambers.

15. The multi-cylinder internal combustion engine according to claim 13, wherein a feed pump by which oil in an oil pan is fed through an oil filter to each part to be supplied with the oil is provided coaxially with the scavenging pump, and an oil passage extending from a discharge port of the feed pump to the oil filter is formed in a crankcase wall.

16. The multi-cylinder internal combustion engine according to claim 11, wherein a feed pump by which oil in an oil pan is fed through an oil filter to each part to be supplied with the oil is provided coaxially with the scavenging pump, and an oil passage extending from a discharge port of the feed pump to the oil filter is formed in a crankcase wall the engine further comprising:

multiple bolt holes for accommodating crankshaft bolts for fixing the crankshaft by fastening together lower and upper cases of the crankcase, wherein each of the left and right outflow holes extends further in the rearward direction of the engine than each of the bolt holes located rearwardly of the crankshaft.

17. The multi-cylinder internal combustion engine according to claim 15, wherein an oil pump mounting surface is formed as a slant surface slanted against a front-rear direction at a lower portion of the crankcase, the oil slinger rib is provided on the upper side of the slant surface, and the discharge port of the feed pump is provided on the lower side of the slant surface.

18. The multi-cylinder internal combustion engine according to claim 16, wherein an oil pump mounting surface is formed as a slant surface slanted against a front-rear direction at a lower portion of the crankcase, the oil slinger rib is provided on the upper side of the slant surface, and the discharge port of the feed pump is provided on the lower side of the slant surface.

19. The multi-cylinder internal combustion engine according to claim 13, wherein a plurality of oil slinger ribs project upwardly from a bottom portion and are formed at rear portions of the crank chambers.

20. The multi-cylinder internal combustion engine according to claim 19, wherein the plurality of oil slinger ribs are formed along inner side surfaces of the lower support walls with tips in a width direction being located on inner sides to not extend beyond the crank webs.

* * * * *